US008056569B2

(12) United States Patent
Berhault

(10) Patent No.: US 8,056,569 B2
(45) Date of Patent: Nov. 15, 2011

(54) TYPICALLY SPHERICAL APPLICATOR TIP FOR APPLICATION OF COSMETIC PRODUCTS

(75) Inventor: Alain Berhault, Paris (FR)

(73) Assignee: Albea Services (FR)

( * ) Notice: Subject to any disclaimer, the term of this patent is extended or adjusted under 35 U.S.C. 154(b) by 923 days.

(21) Appl. No.: 11/853,369

(22) Filed: Sep. 11, 2007

(65) Prior Publication Data

US 2009/0065018 A1 Mar. 12, 2009

(51) Int. Cl.
*A45D 40/26* (2006.01)

(52) U.S. Cl. ..... 132/218

(58) Field of Classification Search ..... 132/216–218, 132/318, 320; 15/167.3, 167.1, 159.1, 187, 15/160; 401/126, 122
See application file for complete search history.

(56) References Cited

U.S. PATENT DOCUMENTS 4,422,986 A * 12/1983 Cole ..... 264/39
2006/0093425 A1* 5/2006 Gueret ..... 401/129
2008/0083421 A1* 4/2008 Malvar et al. ..... 132/218

* cited by examiner

*Primary Examiner* — Todd Manahan
*Assistant Examiner* — Brianne O'Neill
(74) *Attorney, Agent, or Firm* — Banner & Witcoff, Ltd.

(57) ABSTRACT

The applicator tip comprises:

a) an application means comprising a rigid core and a plurality of flexible projections, b) an axial handle member having an axial direction and comprising an upper end adapted to be fixedly connected to a rod, and operatively associated with the rigid core through its lower end, and characterized in that:

1) the applicator tip has, along the axial direction, a length $L_0$ ranging from 10 mm to 30 mm, application means having a length $L_1$ which ranges from 6 mm to 15 mm, wherein $L_0=L_1+L_2$, 2) the application means having a transverse width T, taken in a transverse plane, which is variable as a function of the axial distance L which varies from 0 to $L_1$, the function T=f(L) having a maximum value of $T_1$ for the transverse width when L is between $0.3.L_1$ and $0.7.L_1$.

20 Claims, 7 Drawing Sheets

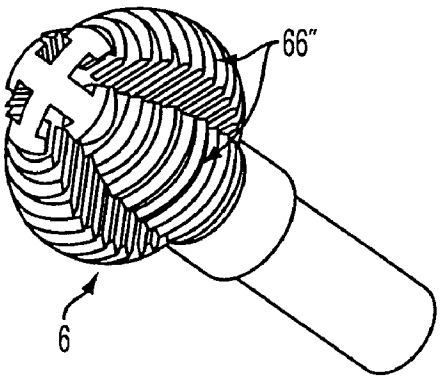
FIG. 2a
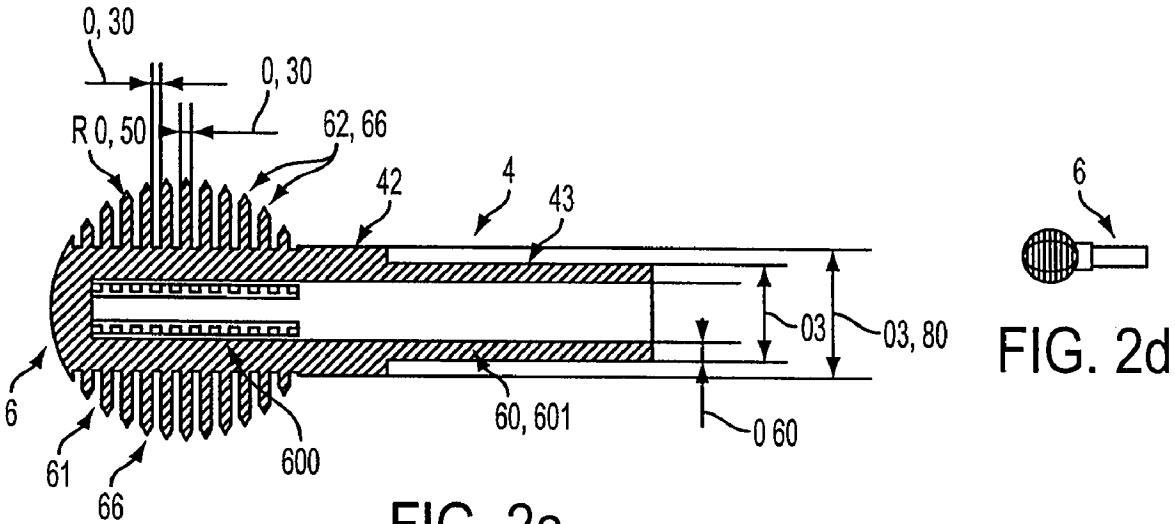
FIG. 2c
FIG. 2d
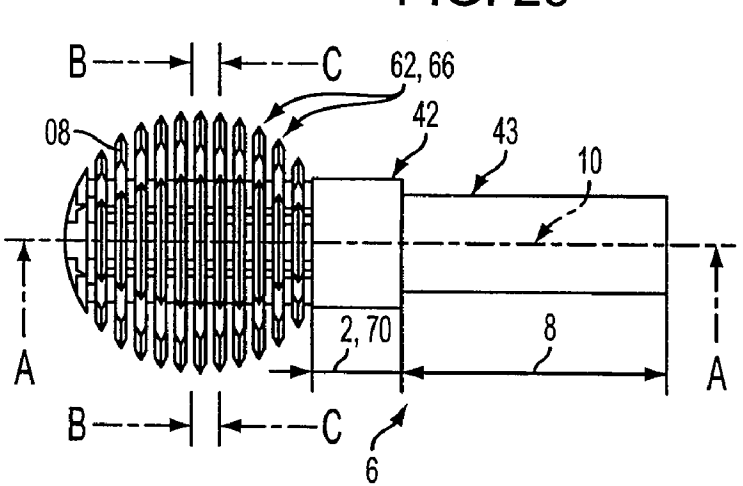
FIG. 2b
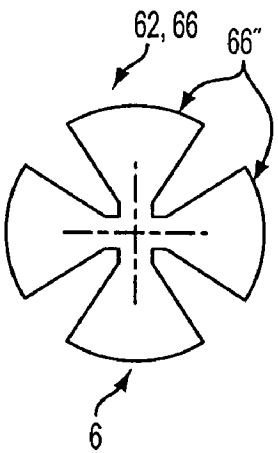
FIG. 2e
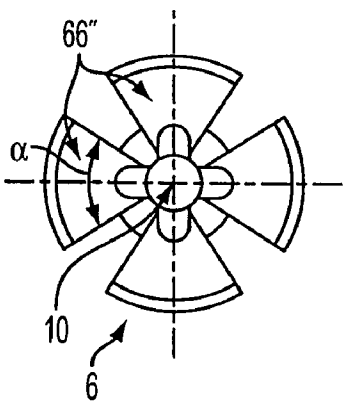
FIG. 2f

TYPICALLY SPHERICAL APPLICATOR TIP FOR APPLICATION OF COSMETIC PRODUCTS

BACKGROUND OF THE INVENTION (a) Field of the invention

The invention concerns the field of applicators for cosmetic products, typically make-up products for the eyes and lips.

(b) Description of Prior Art

A very large number of applicators of all kinds, in particular in the field of skin and eye care, and particularly of the eyes, with mascara applicators, are already known.

There applicators, which are adapted to operate jointly with a container defining a reservoir for mascara, typically comprise:

a) a cap adapted to seal the container and to be used as prehension means for the applicator, b) and axial rod, c) and a brush, the rod being unitary with the cap at one of its ends, and with the brush at the other end thereof, the brush comprising a metallic twist on which a plurality of bristles are fixedly mounted.

With respect to the brush, a very large number of embodiments of brushes are already known.

Thus, the brushes described in the following French Patents are known: FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 593, FR 2 774 269, FR 2 796 531, FR 2 796 532, FR 2 800 586.

Also known are the brushes described in the following: U.S. Pat. No. 4,733,425, U.S. Pat. No. 4,861,179, U.S. Pat. No. 5,357,987, U.S. Pat. No. 5,595,198, U.S. Pat. No. 6,241, 411, U.S. Pat. No. 6,427,700.

Also known is French Patent FR 2 868 264 which, instead of brushes, discloses longitudinal applicators which are molded with plastic material and provide tips intended to be fixedly connected at one end of an axial rod, the other end being fixedly connected to a prehension means.

On the one hand, molded brushes and applicators of the prior art do not allow to provide all the make-up shades desired, with all the sharpness hoped for, since the face is all but a flat surface to be covered with a decorative or protective coating.

On the other hand, there is a need for new molded brushes and applicators in order to provide new make-up effects. Indeed, the possibilities of causing variation in the nature of molded brushes and applicators are dependent in particular on the known processes of manufacture.

Finally, in the field of make-up, there is a requirement for permanently renewing the offer of products by placing new products on the market in order to meet new needs or those which are not satisfied to this day.

SUMMARY OF THE INVENTION

According to the invention, the applicator tip, adapted to be mounted at one so-called lower end of a rod of an applicator of cosmetic products, the other so-called upper end of the rod being unitary with a manual prehension means for the applicator, comprises:

a) an application means comprising a typically rigid core and a plurality of typically flexible projections, the plurality of projections being adapted to hold a portion of the cosmetic product when the applicator tip is dipped into the cosmetic product, b) an axial handle member having an axial direction and comprising an upper end adapted to be fixedly mounted on the lower end of the rod through a fixation means, and operatively connected, through its lower end, with the core, the handle member and the core typically constituting a single-piece member, the assembled rod and axial handle member typically having the axial direction, and characterized in that:

i) the core and the handle member constitute a plastic material molded part;

ii) the application means comprises a plurality of N projections of plastic material, the plurality of projections and the molded portion typically constituting a single-piece molded member;

iii) the applicator tip having, along the axial direction, a length $L_0$ ranging from 10 mm to 30 mm, the application means having a length $L_1$ ranging from 4 mm to 15 mm and the axial rod having a length $L_2$ ranging from 6 mm to 15 mm, wherein $L_0=L_1+L_2$;

iv) the application means having a transverse width T, viewed in a transverse plane that is perpendicular to the axial direction, that varies as a function of the axial distance L ranging from 0 to $L_1$, the function T=f(L) having a maximum value $T_1$ for the transverse width when L is between 0.3. $L_1$ and 0.7. $L_1$.

The applicator tips according to the invention make it possible to solve the problems raised. Indeed, they have a geometrical configuration which is distinct, in particular through its shape and size, from those of the molded brushes and applicators of the state of the art, which makes it possible in particular to produce a great make-up sharpness even in the lesser accessible parts of the face.

According to a particularly preferred embodiment of the invention, the core is a core which substantially defines a truncated sphere with radius R, the truncation of the sphere corresponding to the junction between the core and the handle member. This rounded shape of the core advantageously makes it possible to obtain an applicator tip having a rounded surface of envelope without hollows that are too deep between the projections. As a matter of fact, hollows which are too deep could cause an accumulation of too much cosmetic product due to the fact that it is difficult to combine an applicator having a rounded surface of envelope with an efficient wiper. Thus, in view of the shape of this core, it is possible to obtain a rounded surface of envelope with projections of substantially identical sizes so that the properties of the projections, for example softness, are homogenous, which allows for a homogenous application of the cosmetic product.

BRIEF DESCRIPTION OF DRAWINGS

FIG. 2*a* is a perspective view of another embodiment of applicator tip according to the invention, as a single-piece member.

FIG. 2*b* is a side view of the applicator illustrated in FIG. 2*a*.

FIG. 2*c* is an axial cross-section taken along axial plane A-A of FIG. 2*b*.

FIG. 2*d* is a side view, on a true scale, of the applicator tip of FIG. 2*a* whose axial length $L_0$ is 17 mm.

FIG. 2*e* is a transverse cross-section view taken along transverse plane B-B of FIG. 2*b*.

FIG. 2*f* is a transverse cross-section view taken along transverse plane C-C of FIG. 2*b*.

DESCRIPTION OF PREFERRED EMBODIMENTS

All the figures of the drawings relate to the invention.

FIGS. 1*a* to 1*e*, 2*a* to 2*f*, 3*a* to 3*c*, and 4*a* to 4*c* relate respectively to four different embodiments of applicator tips 1,1" constituting single-piece molded members 6.

Figure 4A:
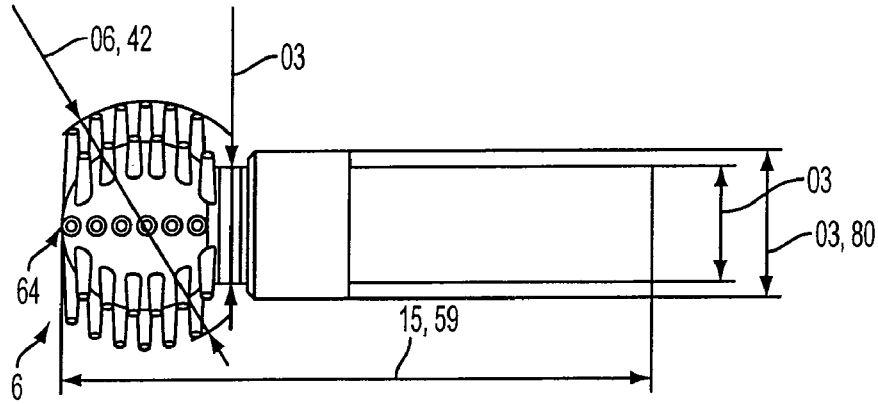
FIG. 4*a* is a side view of yet another embodiment of applicator tip according to the invention, as a single-piece molded member.
Figure 4B:
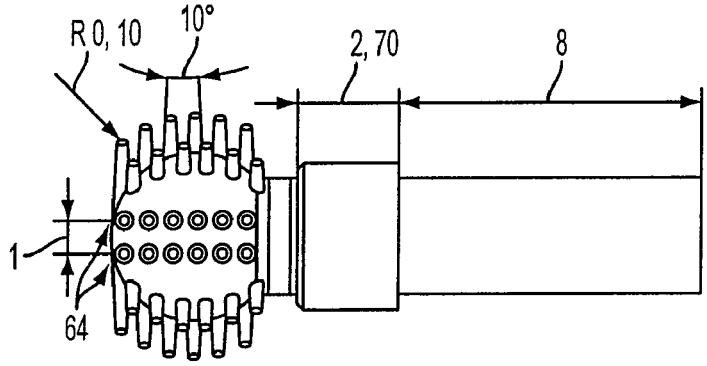
FIG. 4*b* is another side view after 90° rotation of the applicator tip of FIG. 4*a*.
Figure 4C:
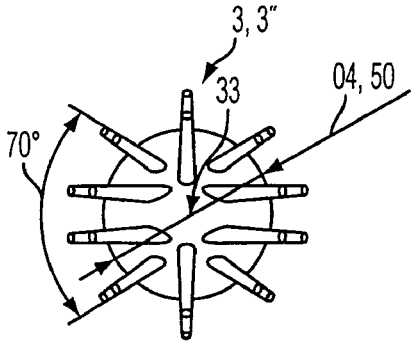
FIG. 4*c* is a front view of the applicator tip of FIG. 4*a*.
Figure 4D:
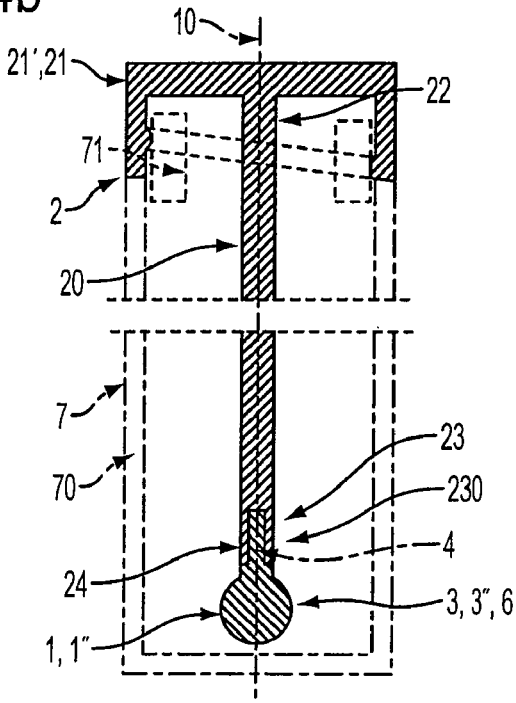
FIG. 4*d* is a cross-section view of an applicator provided with an axial rod which is unitary at its lower end with a tip according to the invention.

With reference to FIG. 4*d* it will be seen that there is illustrated an applicator 2 provided with an axial rod 20 which is unitary at its lower end 23 with a tip 1 according to the invention. On this Figure, there is schematically illustrated in dotted lines a container 70 which is typically associated with applicator 2 and contains the cosmetic product to be applied, in a manner to constitute a dispenser applicator 7. The neck 71 of such a container 70 is generally provided with a wiper (not illustrated in FIG. 4*d*).

Figure 5A:
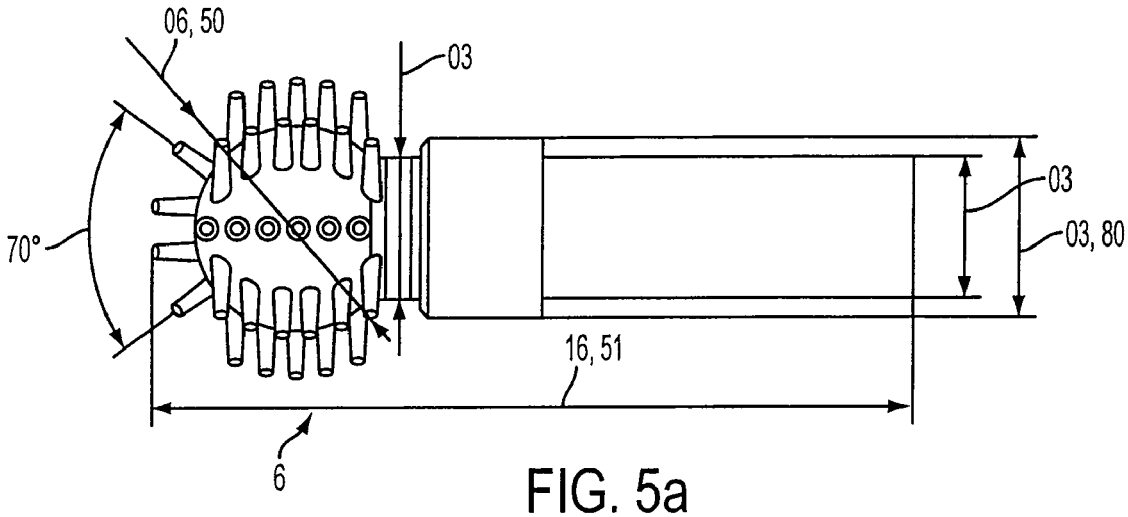
FIG. 5*a* is a side view of yet another embodiment of an applicator tip according to the invention, as a single-piece molded member.
Figure 5B:
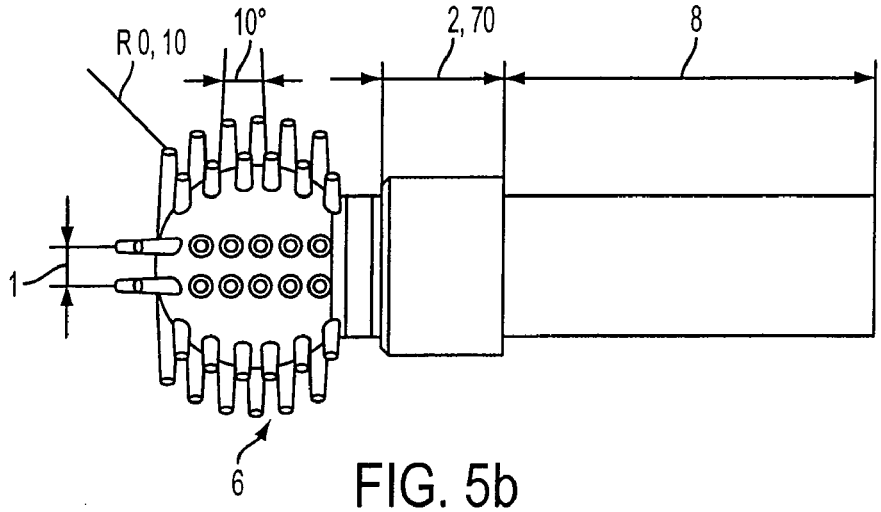
FIG. 5*b* is a side view after 90° rotation of the applicator tip of FIG. 5*a*.
Figure 5C:
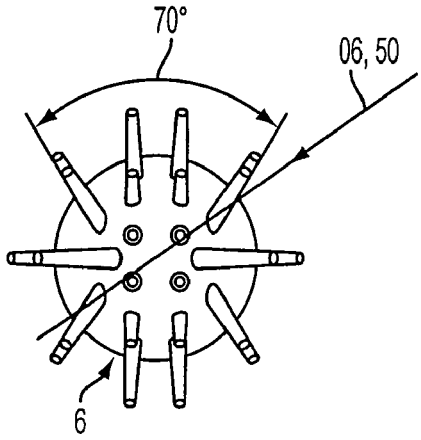
FIG. 5*c* is a front view of the applicator tip of FIG. 5*a*.

With reference to FIGS. 5*a* to 5*c* which are respectively similar to FIGS. 4*a* to 4*c*, it will be seen that they relate to another embodiment of applicator tip 1 defining a single-piece molded member 6.

FIGS. 6*a* to 7*j* illustrate an embodiment of the production of an applicator tip 1,1" defining a single-piece molded member 6 in which an expanded blank 8 is produced by molding, and the blank is folded upon itself to constitute single-pieced molded member 6.

Figure 6A:
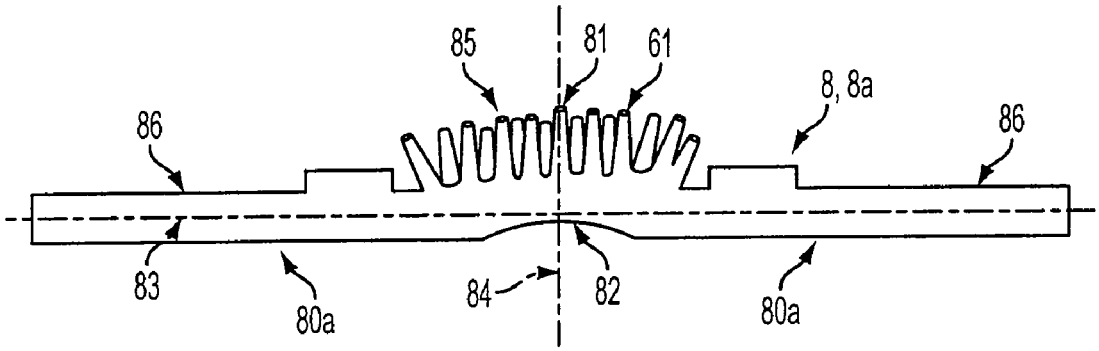
FIG. 6*a* is a lateral side view of the blank of an applicator tip according to the invention, expanded in longitudinal direction.
Figure 6B:
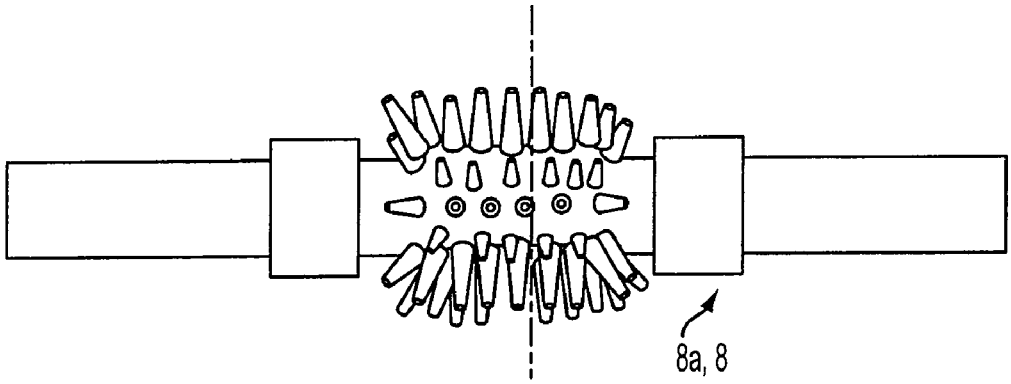
FIG. 6*b* is a lateral view from above of the blank of FIG. 6*a* obtained by 90° rotation of the blank of FIG. 6*a*.
Figure 6C:
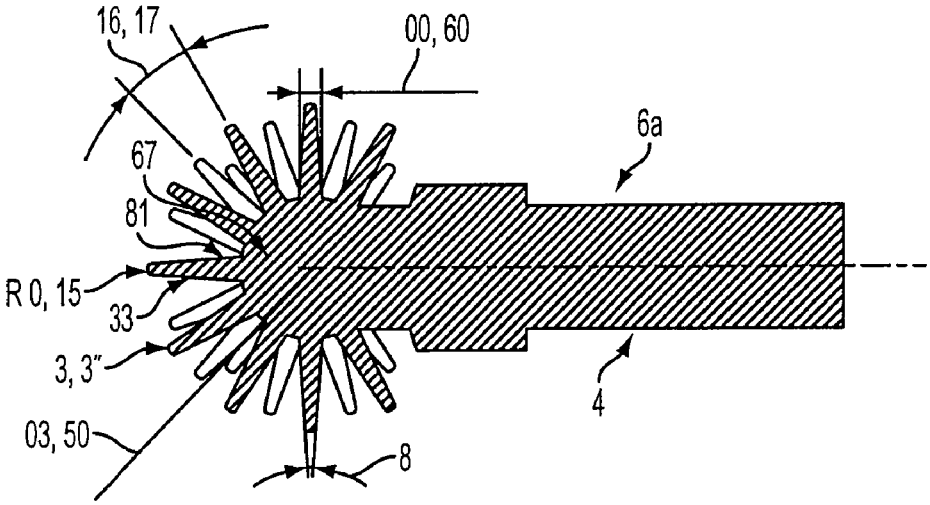
FIG. 6*c* is a side view, similar to FIG. 1*c*, of the tip of FIG. 6*a* obtained by folding the blank along a median plane.

FIGS. 6*a* to 6*c* illustrate the case of a blank 8,8*a* with two arms 80,80*a*. With reference to FIG. 6*c* it will be seen that tip 6,6*a* is obtained by folding blank 8,8*a* along a median plane 84 through a thinned down portion 82 of a central portion 81 defining a hinge. In this embodiment, the central portion 81 corresponds to portion 85 of the blank adapted to constitute the application means 3" after folding.

Figure 7A:
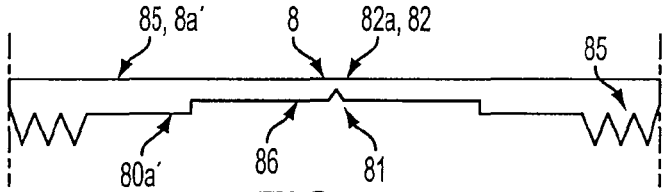
FIG. 7*a* is a partial lateral side view of a blank of an applicator tip according to the invention which is a variant of the blank of FIG. 6*a*.
Figure 7B:
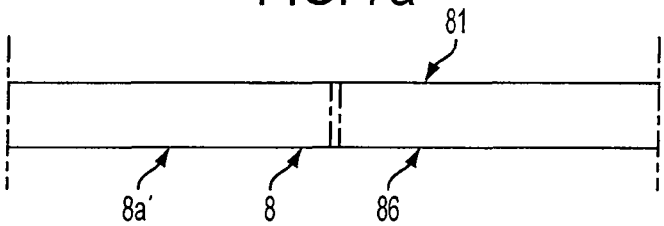
FIG. 7*b* is a lateral view from above of the blank of FIG. 7*a*.
Figure 7C:
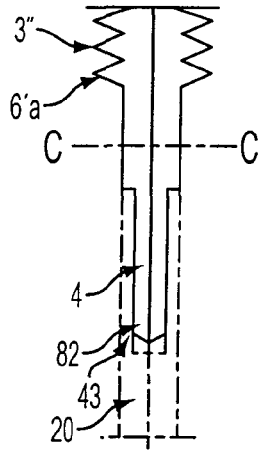
FIG. 7*c* is a partial view of a molded member obtained by folding the blank of FIG. 7*a* to define a tip as assembled at the end of a rod illustrated in dotted line.

FIGS. 7*a* to 7*c* schematically illustrate a variant of the production of FIGS. 6*a* to 6*c*, in which blank 8*a* is a blank 8*a*' with two arms 80' in which the flexible portion defining a hinge 82 is formed in portion 86 of the blank which is adapted to constitute the handle member 4.

With particular reference to FIG. 7*c* it will be seen that molded member 6*a*' is obtained by folding the blank of FIG. 7*a* to define tip 1" which has been illustrated at the end of rod 20, shown in dotted line.

Figure 7E:
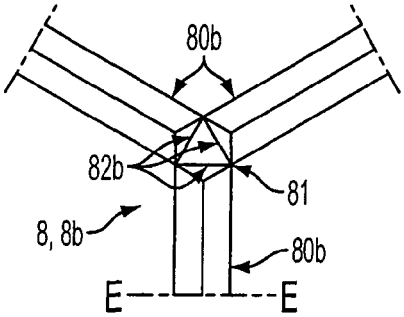
FIG. 7*e* is a partial view from above of a blank with three arms.
Figure 7D:
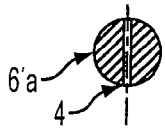
FIG. 7*d* is a cross-section taken along transverse plane C-C of FIG. 7*c*.
Figure 7F:
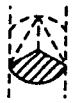
FIG. 7*f* is a cross-section taken along plane E-E of FIG. 7*e*.
Figure 7G:
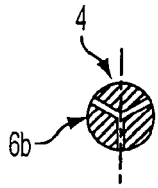
FIG. 7*g* which is similar to FIG. 7*d*, is a transverse cross-section view of the handle member of the molded member formed by folding the blank of FIG. 7*e*.

FIGS. 7*e* to 7*g* relate to the case where blank 8 is a blank 8*b* with three arms 80*b* in which the central portion 81 comprises three thinned down portions 82*b* disposed as an isosceles triangle.

Figure 7H:
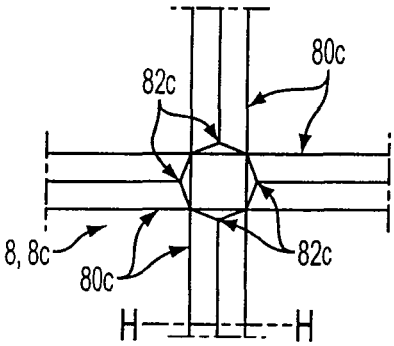
FIG. 7*h* is a partial view from above of a blank with four arms.
Figure 7J:
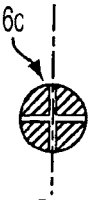
FIG. 7*j* is a transverse cross-section view of the handle member of the molded member formed by folding the blank illustrated in FIG. 7*h*.
Figure 7I:
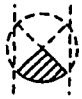
FIG. 7*i* is a cross-section view taken along plane H-H of FIG. 7*h*.

FIGS. 7*h* to 7*j*, which are respectively similar to FIGS. 7*f* to 7*g*, relate to the case where blank 8 is a blank 8*c* with four arms 80*c* in which the central portion 81 comprises four thinned down portions 82*c* disposed as a square.

According to the invention, the maximum value $T_1$ of the transverse width may be between $0.7.L_1$ and $1.3.L_1$.

Figure 3B:
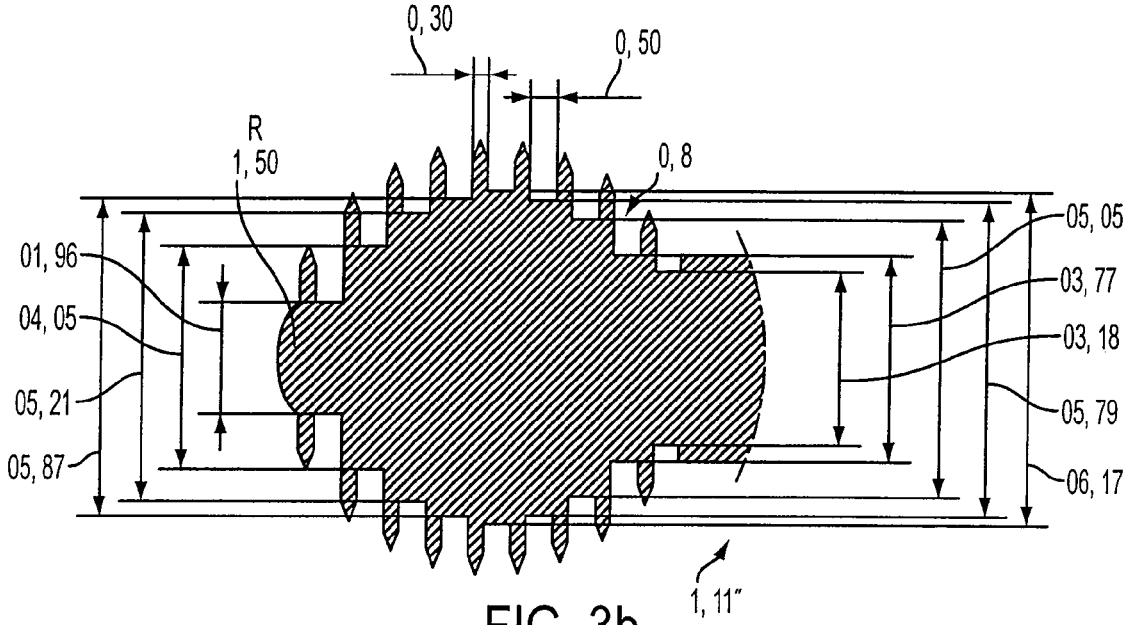
FIG. 3*b* is a partial axial cross-section view taken along line A-A of FIG. 3*a*.
Figure 3A:
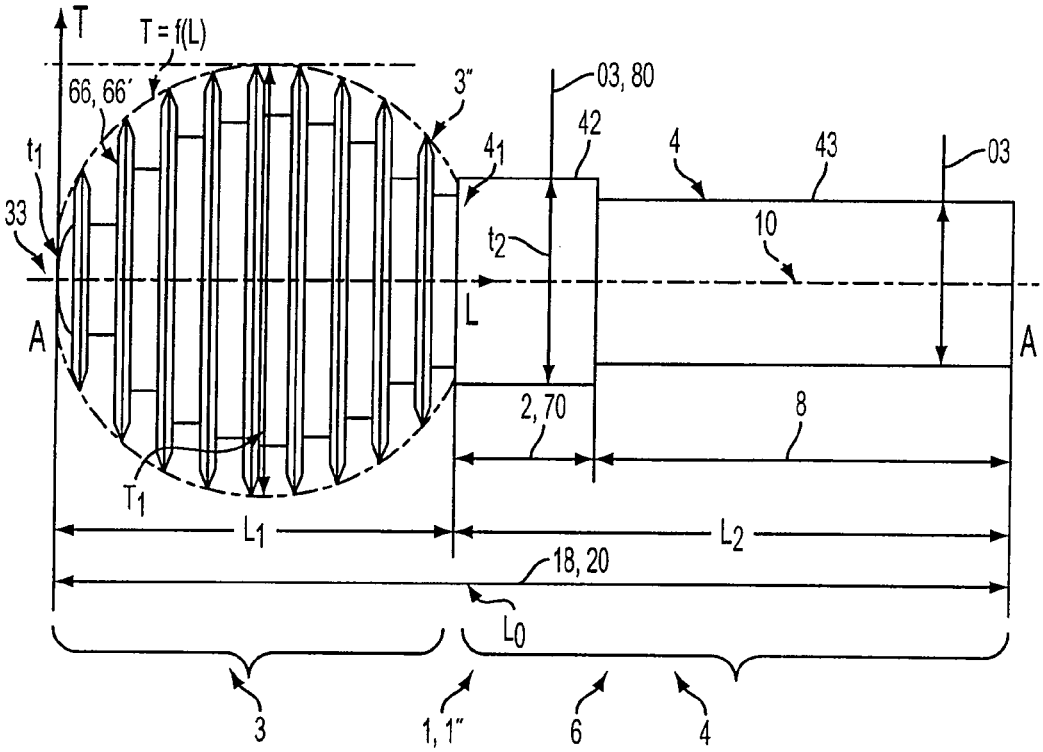
FIG. 3*a* is a side view of yet another embodiment of applicator tip according to the invention, as a single-piece molded member.
Figure 3C:
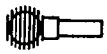
FIG. 3*c* is a side view, on a true scale, of the applicator tip of FIG. 3*a* whose axial length $L_0$ is 18.2 mm.

As can be seen particularly in FIG. 3*a*, the value of $T_1$ is near $L_1$, so that the application means 3,3" has a surface of envelope corresponding substantially to a truncated sphere.

The function T=f(L) may have, at least in an axial plane comprising axial direction 10, a so-called first minimum value $t_1$ for L=0, L being taken as equal to 0 at the so-called lower end 33 of application means 3 and a so-called second minimum value $t_2$ for $L=L_1$, wherein L is taken as $L_1$ at the portion of the application means 3 adjoining the lower end 41 of handle member 4, the first minimum value $t_1$ being typically equal to 0, the second minimum value $t_2$ corresponding substantially to the transverse overloading of handle member 4, typically to its diameter D, so as to constitute a so-called "ball shaped" application means 3,3".

Figure 1A:
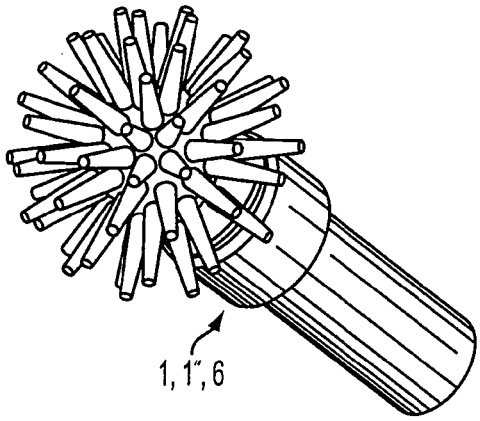
FIG. 1*a* is a perspective view of an applicator tip according to the invention.
Figure 1E:
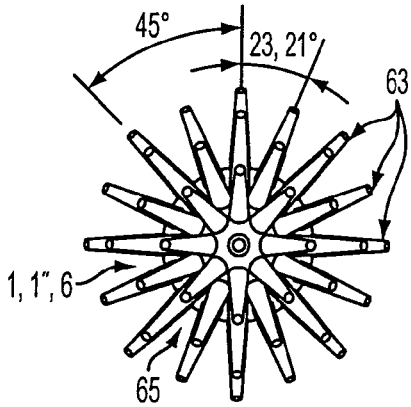
FIG. 1*e* is a front view of the applicator tip of FIG. 1*a*.
Figure 1C:
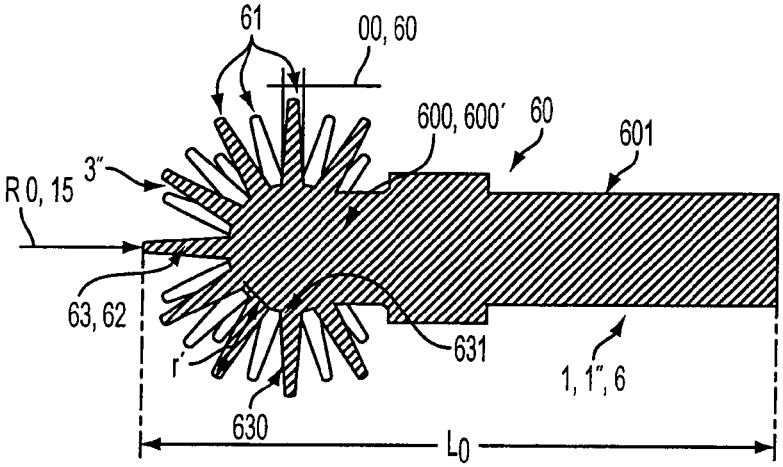
FIG. 1*c* is an axial cross-section taken along line A-A of FIG. 1*b*.
Figure 1D:
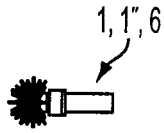
FIG. 1*d* is a side view, on a true scale, of the applicator tip of FIG. 1*a* whose axial length $L_0$ is 16 mm.
Figure 1B:
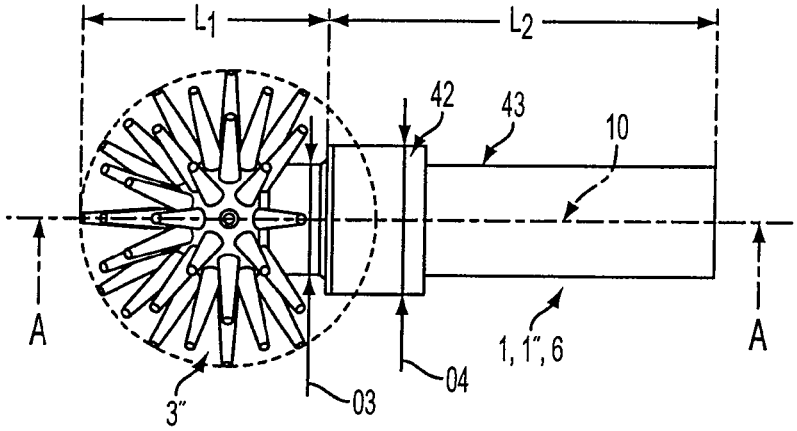
FIG. 1*b* is a side view of the same applicator tip.

According to an embodiment of the invention, and as illustrated for example in FIG. 1*c*, core 30 and handle member 4 may constitute a molded portion 60,600,601, which is typically rigid, and is made of plastic material, and application means 3 may be an application means 3" comprising a plurality 61 of N projections of plastic material 62, the plurality 61 of projections and the molded portion 60 typically constituting a single-piece molded portion 6 made of at least one plastic material, so that tip 1 is a tip 1" made of molded plastic material.

The projections 62 may be so-called radial projections 63 disposed perpendicularly with respect to the core.

The radial projections 63 may be of truncated shape, in which case each projection comprises a free end 630 and an end 631 that is unitary with core 600, the free end 630 having a transverse cross-section which is smaller than that of the end 631 which is unitary with core 600.

The application means 3" may comprise N radial projections 63, wherein N ranges between 20 and 100, and typically between 30 and 80.

The radial projections 63 may have a length r' which extends from 1.5 mm to 3.5 mm, typically from 2 mm to 3 mm, and preferably r' is equal to 2.5 mm.

Core 600 may be a core 600' constituting a substantially truncated sphere of radius R, the truncatio of the sphere corresponding to the junction of core 600' and handle member 601.

As illustrated for example in FIG. 3*a*, handle member 601 may have a larger transverse dimension D, typically a diameter D, which typically ranges from 2 to 5 mm, and preferably from 2.5 to 4.5 mm.

As illustrated for example in FIGS. 4*a* and 4*b*, the radial projections 63 may constitute a plurality of axial alignments 64, the number of axial alignments 64 ranging from 5 to 15, and typically from 8 to 12.

The embodiment of tip 1,1" of FIGS. 4*a* to 4*c* comprises 10 axial alignments, as this will appear in FIG. 4*c*.

As illustrated in FIG. 1*e*, the radial projections 63 may constitute a so-called hexagonal arrangement 65, each radial projection 63 being typically surrounded with six radial projections 63 symmetrically disposed at the vertices of a regular hexagon.

As illustrated in FIGS. 2*a* to 3*c*, the projections 62 may be so-called transverse projections 66, these transverse projections 66 being disposed in a plurality of n transverse planes which are typically perpendicular to the axial direction, in which case n varies between 5 and 20 and preferably between 8 and 15.

As illustrated in FIGS. 3*a* and 3*b*, the transverse projections 66 may be so-called circular projections 66', each circular projection 66' defining a typically flexible circular tongue which extends over 360°.

As illustrated in FIGS. 2*a* to 2*d*, each transverse projection 66 of a same transverse plane may typically comprise a plurality of N' projections 66" which are typically symmetrical with respect to axial direction 10, in which n' is between 3 and 6, and is typically equal to 4.

Each projection 66" may define an angular sector of angle $\alpha$ smaller than 360°/n', as illustrated in FIG. 2*f*, wherein n=4.

As illustrated in FIG. 3*a*, handle member 4,601 comprises two portions of different cross-section: a so-called lower portion 42 having a transverse cross-section which typically approaches that of the rod, and a so-called upper portion 43 having a reduced cross-section, in a manner to be adapted to be operatively associated with rod 2 through its lower tubular end 230, typically by snapping or welding.

As illustrated in FIGS. 6*a* to 7*j*, in the process for manufacturing a tip according to the invention, a blank 8 of tip constituting a single-piece member may be produced by molding, typically by injection or injection-compression, the tip comprising n arms 80 which are articulated with respect to a central portion 81 comprising or constituting at least one hinge 82, in a manner to constitute the single-piece tip 6 by folding arms 80, wherein n typically varies from 2 to 4.

According to an embodiment illustrated in FIGS. 7*a* to 7*j*, the central portion 81 comprising or constituting at least one hinge 82 may be located at the upper end of the handle member.

The case of a blank 8,8*a*' with two arms 80*a*' has been illustrated in FIGS. 7*a* to 7*d*.

The case of a blank 8,8*b* with three arms 80*b* has been illustrated in FIGS. 7*e* to 7*g*.

The case of a blank 8,8*c* with four arms 80*c* has been illustrated in FIGS. 7*h* to 7*j*.

As illustrated in FIGS. 6*a* to 6*c*, the central portion 81 comprising or defining at least one hinge 82 may be located at the lower end 33 of the application means, and typically at the lower end 67 of the core 600 of the molded member.

Another object of the invention is provided by an applicator 2 for cosmetic products, typically mascaras, comprising an applicator tip 1,1" according to the invention, the applicator 2 comprising a rod 20 typically having the axial direction 10, rod 20 being fixedly connected, at its so-called lower end 23, to the applicator tip 1,1", and at its so-called upper end 22, to a means of manual prehension 21.

Such an applicator has been illustrated in FIG. 4*d*.

Another object of the invention is provided by a dispenser applicator 7 of cosmetic products, typically mascaras, comprising an applicator 2 according to the invention which is operatively associated with a container 70 adapted to contain the cosmetic product, the container 70 comprising a typically threaded neck 71, typically provided with a wiper, the typically exteriorly threaded neck 71 being operatively associated with the prehension means 21 constituting an interiorly threaded plug 21 to seal neck 71.

EXAMPLES

I) Tips 1,1" constituting single-piece molded members 6 of plastic material, according to FIGS. 1*a* to 5*c*, were manufactured by molding.

Tests were made with PE and with an elastomer, however any plastic material that can be molded for allowing to simultaneously constitute an axial handle member 4 which is relatively rigid to make sure that the tip 1 is fixedly mounted on rod 20 of applicator 2 and an application means 3,3" comprising a plurality of relatively flexible projections 31, may be used.

To manufacture these tips by molding, the process described in FIGS. 6*a* to 7*j* was used, in particular whenever this was required by the stripping stresses.

I-1) The tip 1,1" according to FIGS. 1*a* to 1*e* was produced.

This applicator tip has an axial length $L_0$ of 16 mm.

Its application means 3,3" comprises a plurality of hexagonally arranged 65 projections 61. The core 600,600' constitutes a truncated sphere 3.5 mm in diameter, the plurality of projections 61 lying in a truncated sphere 8 mm in diameter. The projections 61 are substantially truncated and have a base 631, 0.6 mm in diameter and a rounded end 630.

Its handle member 4 comprised an upper portion 43 3 mm in diameter adapted to be operatively associated with a blind hole formed at the end of the rod 20, as illustrated in FIG. 4*d*, and a lower portion 43, 4 mm in diameter.

I-2) In a similar manner, the tip 1,1" according to FIGS. 2*a* to 2*f* was prepared.

In this tip, the core 600 and the handle member 4 are hollow, and the projections 31 define a plurality of transverse projections 66, each projection comprising four symmetrical projections 66" forming sectors of angle $\alpha$ equal to about 60°.

I-3) In a similar manner, the tip 1,1" according to FIGS. 3*a* to 3*b* was prepared.

In this case, the transverse projections 66 are circular transverse projections 66'.

I-4) In a similar manner, the tip 1,1" according to FIGS. 4*a* to 4*c* was prepared.

In this tip, the plurality of projections 61 constitutes axial alignments 64—10 axial alignments.

I-5) In a similar manner, the tip 1,1" according to FIGS. 5*a* to 5*c*, and which is closely similar to that of FIGS. 4*a* to 4*a*, was prepared. This tip has a lower end 33 which is free of projections 31.

These tips 1,1" were assembled with rods 20 to constitute applicators 2, which are essential elements for dispenser applicators 7 of cosmetic products, in particular make-up products for the eyes, such as mascaras, or make-up products for the lips, or also for the nails.

In use, it was noted that these tips 1,1" provided a fine sharpness of application. In addition, they made it possible to sample only a relatively limited quantity of cosmetic products, which appeared advantageous with respect to the service life of the distributor applicator and the stability in time of the cosmetic product.

LIST OF REFERENCE MARKS

Applicator tip . . . 1,1"
  Axial direction . . . 10
Cosmetic product applicator . . . 2
  Rod of 2 . . . 20
  Manual prehension means of 2 . . . 21
  Threaded plug . . . 21'
  Upper end of 20 unitary with 21 . . . 22
  Lower end of 20 unitary with 21 . . . 23
    Tubular part operatively associated with 43 . . . 230
  Means 1 and 4 for cooperating with 20 . . . 24
Application means of 1 . . . 3
Application means of 6 . . . 3"
  Typically rigid core . . . 30
  Plurality of projections . . . 31
  Unitary projection of 31 . . . 32
  Lower end of 3, 3" . . . 33
Axial handle member of 1 . . . 4
  Upper end of 4 operatively associated with 20 . . . 40
  Lower end of 4 operatively associated with 3 . . . 41
  Lower part operatively associated with 3 . . . 42
  Upper part operatively associated with 20 or 230 . . . 43
Single-piece molded member constituting 1" . . . 6
  Molded part constituting 30+4 . . . 60
    Portion of 60 defining core 30 . . . 600
    Core in shape of truncated sphere . . . 600'
    Portion of 60 constituting
    handle member 4 . . . 601
  Plurality of projections . . . 61
  Projection of 61 . . . 62
  Radial projection . . . 63
  Axial alignment of 63 . . . 64
  Hexagonal alignment . . . 65
  Transverse projection . . . 66
  Circular transverse projection . . . 66'
  Typically symmetrical projection . . . 66"
  Lower end of 6 . . . 67
Dispenser applicator . . . 7
  Container . . . 70
  Neck . . . 71
Blank of 1,1',6 . . . 8
  Arm of 8 . . . 80, 80*a*, 80*b*, 80*c*
  Central portion . . . 81
  Thinned down portion defining hinge . . . 82, 82*a*, 82*b*, 82*c*
  Median plane of 8 . . . 83
  Longitudinal direction of expanded blank . . . 84
  Portion of 8 adapted to constitute 3' . . . 85
  Portion of 8 adapted to constitute 4 . . . 86

What is claimed is:

1. Applicator tip, adapted to be mounted at one lower end of a rod of an applicator of cosmetic products, wherein the other upper end of said rod being unitary with a manual prehension means for said applicator, comprising:

a) an application means comprising a rigid core and a plurality of flexible projections, said plurality being adapted to hold a portion of said cosmetic product when said applicator tip is dipped into said cosmetic product, b) an axial handle member having an axial direction and comprising an upper end adapted to be fixedly mounted on said lower end of said rod through a fixation means, and operatively connected, through its lower end, with said core, said handle member and said core comprising a single-piece member, said assembled rod and axial handle member having said axial direction, and characterized in that:

i) said core and said handle member constitute a molded portion of plastic material wherein said core is a core constituting substantially a truncated sphere of radius R, the truncation of said sphere corresponding to the junction of said core and handle member;

ii) said application means comprises a plurality of N projections extending radially from the core of plastic material, said plurality of projections and said molded portion comprising a single-piece molded member;

iii) said applicator tip having, along said axial direction, a length $L_0$ ranging from 10 mm to 30 mm, said application means having a length $L_1$ ranging from 4 mm to 15 mm and said axial handle member having a length $L_2$ ranging from 6 mm to 15 mm, wherein $L_0=L_1+L_2$;

iv) said application means having a transverse width T, viewed in a transverse plane that is perpendicular to said axial direction, that varies as a function of the axial distance L ranging from 0 to $L_1$, the function $T=f(L)$ having a maximum value $T_1$ for said transverse width when L is between $0.3.L_1$ and $0.7.L_1$.

2. Applicator tip according to claim 1, wherein said maximum value $T_1$ of said transverse width is between $0.7.L_1$ and $1.3.L_1$.

3. Applicator tip according to claim 1, wherein said function $T=f(L)$ has, at least in an axial plane comprising said axial direction, a first minimum value $t_1$ for $L=0$, L being taken as equal to 0 at the lower end of said application means and a second minimum value $t_2$ for $L=L_1$, L being taken as $L_1$ on the part of said application means adjoining the lower end of said handle member, said first minimum value $t_1$ being equal to 0, said second minimum value $t_2$ corresponding substantially to the transverse overloading of said handle member, so as to constitute a ball shaped application means.

4. Applicator tip according to claim 1, wherein said projections are radial projections disposed perpendicularly with respect to said core.

5. Tip according to claim 4, wherein said radial projections are of truncated shape, wherein each projection comprises a free end and an end that is unitary with said core, the free end having a smaller transverse cross-section than that of the end which is unitary with said core.

6. Tip according to claim 4, wherein said application means comprises N radial projections, wherein N ranges between 20 and 100.

7. Tip according to claim 4, wherein said radial projections have a length r' which ranges between 1.5 mm and 3.5 mm.

8. Tip according to claim 1, wherein said handle member has a transverse dimension D ranging from 2 to 5 mm.

9. Tip according to claim 4, wherein said radial projections comprise a plurality of axial alignments, the number of axial alignments ranging from 5 to 15.

10. Tip according to claim 4, wherein said radial projections defining a hexagonal arrangement, each radial projection being surrounded with six radial projections symmetrically disposed at the vertices of a regular hexagon.

11. Tip according to claim 1, wherein said projections are transverse projections, said transverse projections being disposed in a plurality of n transverse planes perpendicular to said axial direction, wherein n varies from 5 to 20.

12. Tip according to claim 11, wherein said transverse projections are circular projections, each circular projection defining a flexible circular tongue which extends over 360°.

13. Tip according to claim 11, wherein each transverse projection of a same transverse plane comprises a plurality of n' projections symmetrical with respect to said axial direction, wherein n' is between 3 and 6.

14. Tip according to claim 13, wherein each projection defines an angular sector of angle $\alpha$ smaller than 360°/n'.

15. Tip according to claim 1, wherein said handle member comprises two portions of different cross-section: a lower portion having a transverse cross-section which approaches that of said rod, and an upper portion having a reduced cross-section, adapted to be operatively associated with said rod through its lower tubular end.

16. Process for manufacturing a tip according to claim 1, wherein a blank of said tip comprises a single-piece member is produced by injection or injection-compression molding, a blank of said tip forming a single-piece member and comprising n arms which are articulated with respect to a central part comprising at least one hinge to form said single-piece tip by folding said arms, wherein n varies from 2 to 4.

17. Process according to claim 16, wherein said central part comprising at least one hinge is located at said upper end of said handle member.

18. Process according to claim 16, wherein said central part comprising at least one hinge is located at said lower end of said application means.

19. Applicator for cosmetic products comprising an applicator tip according to claim 1, said applicator comprising a rod having said axial direction, said rod being fixedly connected at its lower end to said applicator tip, and at its upper end, to a means of manual prehension.

20. Dispenser applicator for cosmetic products comprising an applicator according to claim 19 operatively associated with a container adapted to contain said cosmetic product, said container comprising an exteriorly threaded neck said exteriorly threaded neck being operatively associated with said prehension means comprising an interiorly threaded plug to seal said neck.

* * * * *